United States Patent [19]

Brown et al.

[11] Patent Number: 4,460,845

[45] Date of Patent: Jul. 17, 1984

[54] RIGID CATHODE SUPPORT STRUCTURE FOR AN IN-LINE ELECTRON GUN ASSEMBLY

[75] Inventors: Martin K. Brown, Lancaster; Kenny S. Richard, Ephrata, both of Pa.

[73] Assignee: RCA Corporation, New York, N.Y.

[21] Appl. No.: 326,348

[22] Filed: Dec. 1, 1981

[51] Int. Cl.[3] ..... H01J 29/04; H01J 29/50

[52] U.S. Cl. ..... 313/417; 313/457

[58] Field of Search ..... 313/417, 457, 414

[56] References Cited

U.S. PATENT DOCUMENTS

| | | | |
|---|---|---|---|
| 3,873,879 | 3/1975 | Hughes | 315/13 |
| 3,974,416 | 8/1976 | van der Goot et al. | 313/417 |
| 4,063,128 | 12/1977 | Hughes | 313/409 |
| 4,071,803 | 1/1978 | Takanashi et al. | 313/409 |
| 4,138,624 | 2/1979 | Srowig | 313/417 |
| 4,151,441 | 4/1979 | Puhak | 313/417 X |

FOREIGN PATENT DOCUMENTS 0019249 5/1979 European Pat. Off. .

*Primary Examiner*—Palmer C. Demeo

*Attorney, Agent, or Firm*—Eugene M. Whitacre; Dennis H. Irlbeck; Vincent J. Coughlin, Jr.

[57] ABSTRACT

An in-line electron gun assembly for a color television picture tube has a center cathode disposed between two outer cathodes. Each cathode is supported by a cathode support assembly comprising a cathode eyelet and a beading support member. Each beading support member varies in dimensions as a function of temperature and the center beading support member stabilizes at a higher operating temperature than the outer beading support members. The ends of the beading support members are embedded in a pair of oppositely-disposed insulating support rods. The center beading support member is formed of a material having a low thermal expansion coefficient and the outer beading support members are formed of a material having a higher thermal expansion coefficient. The materials are chosen such that the outer beading support members expand more than the center beading support member but substantially equal to one another so that the cathodes are rigidly affixed to the support rods.

6 Claims, 2 Drawing Figures

RIGID CATHODE SUPPORT STRUCTURE FOR AN IN-LINE ELECTRON GUN ASSEMBLY

BACKGROUND OF THE INVENTION

The invention relates to electron gun assemblies and more particularly to in-line electron gun assemblies of the type used in color television picture tubes.

U.S. Pat. No. 3,974,416 issued to van der Goot et al. on Aug. 10, 1976 discloses a structure for reducing the time dependent thermal displacement of an electrode relative to the tube axis in order to maintain convergence of the electron beams. The van der Goot et al. patent suggest forming the supporting members of the control electrodes, i.e., the electrode nearest the cathodes, from an alloy of iron and nickel, such as Invar or Kovar, having a low thermal expansion coefficient rather than from the more commonly used stainless steel which has a relatively high thermal expansion coefficient. Stainless steel is used to support the more remote electrodes of the electron gun. The van der Goot et al. teaching of using a lower thermal expansion coefficient material for the control electrode support members is utilized in U.S. Pat. No. 4,138,624 issued to Srowig on Feb. 6, 1979. In the Srowig patent, the material of the fastening clamps attached to the center electron gun system control electrode adjacent to the cathode is selected to expand more than the material used to clamp the center system electrodes more remote from the cathode. This judicious selection of support materials includes a compensating tilt to the electron beam axes of the outer systems relative to the center system to maintain convergence during warmup.

U.S. Pat. No. 4,063,128 issued to R. H. Hughes on Dec. 13, 1977 discloses a structure for maintaining the equality of expansion in time and magnitude of the cathode-to-control grid (also referred to as the Gl grid) spacing in an in-line electron gun assembly in order to provide simultaneous cutoff of the beam currents for black level adjustment. In the Hughes patent, assigned to the same assignee as the present invention and incorporated herein for disclosure purposes, the cathode structure comprises three separate cathode assemblies disposed in a plane. Each of the cathode assemblies comprises a cathode sleeve closed at one end with an electron emissive coating disposed on the closed end portion of the sleeve. A filament is mounted within each of the sleeves. The sleeves are attached to cathode eyelets which are affixed to beading support members embedded into a pair of oppositely-disposed glass support rods. The outer support members are formed of 0.51 mm thick material to provide structural rigidity while the center support member is formed of 0.25 mm thick material to permit adequate spacing between the center and outer cathode assemblies. The thicker outer support members provide a better path for conducting heat away from the cathode filaments than does the thinner center support member. Consequently, when thermal equilibrium is achieved at approximately 15 minutes after filament activation, the center cathode assembly is operating at a higher temperature than the outer cathode assemblies. In other words, the temperature rise during warmup is greater for the center cathode assembly than for the outer cathode assemblies. To compensate for the temperature differences among the cathode assemblies, Hughes makes the outer cathode eyelets of a material having a higher thermal expansion coefficient than the material used to make the center cathode eyelet. This permits the outer eyelets to expand at substantially the same rate as the center cathode eyelet, thereby maintaining the change in cathode to Gl grid spacing substantially equal from gun to gun. In the Hughes patent, the center eyelet is constructed of type 52 alloy while the outer eyelets are formed of type 305 stainless steel. Type 52 alloy, as well as other iron-nickel sealing alloys, are described in ASTM standard F30. The material used for all the beading support members in the Hughes structure is type 305 stainless steel.

While the structure disclosed in the Hughes patent provides satisfactory simultaneous cutoff of the beam currents for black level adjustment, the color tracking of the outer beams, i.e., "blue-red tracking", is occasionally a problem. While the cathode sleeves and cathode eyelets expand along the electron beam axis, i.e., along the Z-axis in a manner predicted by the Hughes patent, the color tracking problem appears to be related, to a significant extent, to nonuniform stressing of the cathode support members along the X-Y axes during warmup. If the cathode support members are precisely embedded in the glass support rods of the electron gun, the "blue-red tracking" is satisfactory; however, any variation in the location of the outer support members in the glass support rods or the extent to which the ends of the support members are embedded in the support rods produces nonuniform expansion and deformation of the support members and the support rods resulting in a temperature-induced color variation. The transverse size of the glass support rods cannot be increased to broaden the beading area and provide uniform beading because of the diameter limitation on the neck of the picture tube.

U.S. patent application Ser. No. 258,740 filed on Apr. 29, 1981 by J. R. Hale and assigned to the same assignee as the present invention discloses a support rod having an indexing cavity in one surface thereof to accurately align the support rod with respect to the electron gun elements; however, the tracking problem has not been eliminated by this improvement. The use of Kovar cathode support members having a lower thermal expansion coefficient than the previously used stainless steel support members to minimize both the expansion of the support members and the distortion of the support rods has not made any significant change in the color tracking problem. However, the use of Kovar cathode support members require that the Gl grid be formed from Kovar since the Gl grid is also beaded directly to the glass support rods. Unfortunately, the use of Kovar for grid members is undesirable since Kovar is relatively soft and it is difficult to punch high-precision, sharply-defined apertures in such material.

SUMMARY OF THE INVENTION

In an electron gun assembly having a center cathode disposed between two outer cathodes, each cathode is supported by a cathode support assembly comprising a cathode eyelet and a beading support member. Each beading support member varies in dimensions as a function of temperature and the center beading support member stabilizes at a higher operating temperature than the outer beading support members. The ends of the beading support members are embedded in a pair of oppositely-disposed insulating support rods. The improvement comprises means for maintaining the temperature dependent variations in dimensions of the outer beading support members substantially equal to one another and greater than the temperature dependent variations in dimensions of the center beading support member, thereby rigidly affixing said cathodes to said support rods.

DETAILED DESCRIPTION OF THE PREFERRED EMBODIMENT

Figures 1, 2:
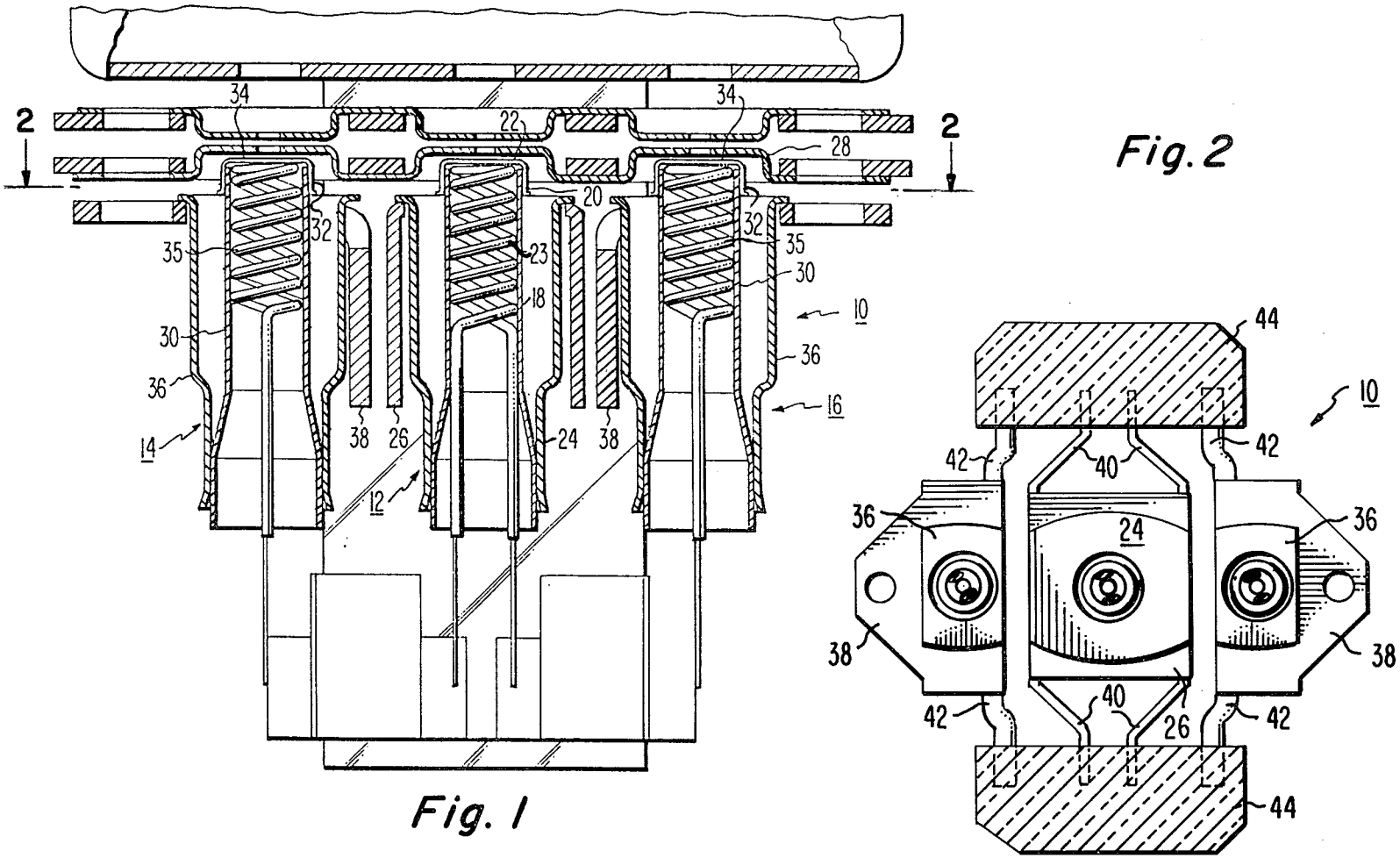
FIG. 1 is a sectional view of a portion of an in-line electron gun assembly.
FIG. 2 is a sectional view taken along line 2—2 of FIG. 1.

In FIG. 1 there is shown a portion of an electron gun assembly 10 of a type used in color television picture tubes. Except for different materials used, the prior art electron gun assembly and the electron gun assembly featuring temperature compensation in accordance with the present invention utilize the same structure; consequently, the detailed description of the structure depicted in FIG. 1 is applicable to both.

The electron gun assembly 10 comprises a center cathode assembly 12, a first outer cathode assembly 14, and a second outer cathode assembly 16. The center cathode assembly 12 comprises a cathode sleeve 18 closed at the forward end by a cap 20 having an end coating 22 of an electron emissive material thereon. A filament 23 is mounted within the cathode sleeve 18. The electron emissive coating 22 is supported at a predetermined spacing from a Gl grid 28 (also referred to as the control grid) by a center cathode eyelet 24 which is attached to the cathode sleeve 18 as well as to a fixed center cathode beading support member 26. This predetermined spacing is established during fabrication and is approximately equal to 0.13 mm.

Similarly, the first and second outer cathode assemblies 14 and 16 each comprise a cathode sleeve 30 closed at the forward end by a cap 32 having an end coating 34 of an electron emissive material thereon. A filament 35 is mounted within each cathode sleeve 30. The electron emissive coatings 34 are each maintained at a predetermined spacing from the Gl grid 28 by a cathode eyelet 36 which is attached to the cathode sleeve 30 as well as to a fixed outer cathode beading support member 38. The predetermined spacings of the outer cathode assemblies are also established during fabrication and are substantially equal to the spacing of the center cathode assembly, which is approximately 0.13 mm.

Warmup of Prior Art Guns

In the prior art structure, such as that disclosed in U.S. Pat. No. 4,063,128 to Hughes, referenced above, the center cathode eyelet 24 is preferably constructed of type 52 alloy, having a thermal expansion coefficient within the range of about 9.6 to 10.1 microns per meter per degree centigrade. The preferred material for the outer eyelets 36 is type 305 stainless steel, having a thermal expansion coefficient of 20 microns per meter per degree centigrade. The center cathode beading support member 26 and the outer cathode beading support members 38 are formed of type 305 stainless steel. The center support member 26 has a thickness of 0.25 mm and the outer support members 38 have a thickness of 0.51 mm. This selection of materials assured that the variations in cathode-to-grid spacing due to temperature changes during warmup were kept substantially equal from cathode to cathode.

As shown in FIG. 2, the center cathode support member 26 has a pair of center beading projections 40 extending outwardly from opposite ends thereof. The center projections 40 are integral with the center support member 26. The outer cathode support members 38 also include integral outer beading projections 42 extending outwardly from the opposite ends of the support members. The beading projections 40 and 42 are embedded into a pair of oppositely-disposed glass support rods 44. The support rods 44 and the procedure for performing the beading operation are described in the copending J. R. Hale patent application Ser. No. 258,740 referenced above and incorporated herein for the purpose of disclosure. In the prior art electron gun structures, in which the center cathode support member 26 and the outer cathode support members 38 are formed of type 305 stainless steel, the center beading projections 40 expand more during warmup than the outer beading projections 42 since the temperature of the center cathode assembly is higher than the outer cathode assemblies. In the ideal electron gun assembly in which the beading projections 40 and 42 are equally embedded into the support rods 44, the increased expansion of the center beading projection 40 is compensated by the difference in material thickness between the center support member and the outer support members so that the forces acting on the support rods 44 are minimal. However, in a small percentage of electron guns, the outer beading projections 42 of one of the outer support members 38 are incompletely embedded or are misaligned within the support rods 44. Therefore, the greater expansion of the center beading projections 40 and the secure attachment of only one of the outer support members 38 produces nonuniform stress within the electron gun assembly 10. The nonuniform stress generally causes movement in one of the outer cathode assemblies relative to the other outer cathode assembly so that the blue and red-producing electron beams do not track properly. Attempts to correct the problem by using low thermal expansion coefficient Kovar (about 5 microns per meter per degree centigrade) as the material for the supports 26 and 38 have been unsuccessful.

Warmup of Present Invention Guns

To correct the blue-red tracking problem incurred during warmup, the outer cathode support members 38 are made of material having a higher thermal expansion coefficient than the material used to make the center cathode support member 26. Additionally, the thermal expansion coefficient of the outer cathode support members 38 is selected to be lower than the thermal expansion coefficient of the outer cathode eyelets 36 which are attached to the outer support members 38. Furthermore, the ratio of the thermal expansion coefficients of the outer support members 38 to the center support member 26 must be such that the outer beading projections 42 expand more than the center beading projections 40 so that the support rods 44 exert a tension on the center projections 40. In other words, a push-pull cathode support structure is required in order to provide proper color tracking during warmup. In the novel push-pull structure, the outer beading projections 42 exert a sufficient outward force on the support rods 44 to keep the center beading projections 40 in tension over the operating temperature range of the electron gun. Even in electron gun assemblies in which the outer beading projections 42 are somewhat misaligned or not completely embedded within the support rods 44, the expansion of the outer beading projections 42 will be substantially equal to one another and greater than the expansion of the center beading projections 40 despite the higher operating temperature of the center cathode assembly and the correspondingly higher temperature of the center support member 26. This structure will provide a "rigid-box" that will prevent movement on one of the outer cathode assemblies relative to the other outer cathode assembly.

In the present novel structure, the center cathode support member 26 is constructed of type 42 alloy, having a thermal expansion coefficient within the range of about 4.0 to 4.7 microns per meter per degree centigrade. The outer cathode support members 38 are constructed of type 52 alloy, having a thermal expansion coefficient within the range of about 9.6 to 10.1 microns per meter per degree centigrade. With the above-disclosed cathode support materials, the Gl grid 28 can be constructed from type 305 stainless steel which can be more accurately formed than the previously required Kovar material.

While the preferred materials are disclosed to be type 42 alloy for the center cathode support member 26 and type 52 alloy for the outer cathode support members 38, it should be clear to one skilled in the art that any metals having a thermal expansion coefficient equal to or less than 52 alloy and a ratio of thermal expansion coefficients of the outer support members to the center support member of between about 1.8 to about 2.6 would be satisfactory to provide the rigid push-pull cathode structure required for proper blue-red tracking.

What is claimed is:

1. In an electron gun assembly having a center cathode disposed between two outer cathodes, each of said cathodes being supported by a separate cathode support assembly comprising a cathode eyelet and a beading support member, wherein each of said beading support members varies in dimensions as a function of temperature and the center beading support member stabilizes at a higher operating temperature than the outer beading support members, each of said beading support members having opposite ends which are embedded in a pair of oppositely-disposed insulating support rods, the improvement comprising means for maintaining said temperature dependent variations in dimensions of said outer beading support members substantially equal to one another and greater than the temperature dependent variations in dimensions of said center beading support member thereby rigidly affixing said cathodes to said support rods.

2. An electron gun assembly in accordance with claim 1 wherein said means for maintaining includes said center beading support member having a smaller thermal expansion coefficient than the outer beading support members such that expansion of each of the outer beading support members is substantially equal to one another and greater than that of the center beading support member over their operating temperature ranges.

3. An electron gun assembly in accordance with claim 2 wherein said center beading support member is formed of a material having a thermal expansion coefficient between about 4.0 to about 4.7 microns per meter per degree centigrade and said outer beading support members are each formed of a material having a thermal expansion coefficient between about 9.6 to about 10.1 microns per meter per degree centigrade.

4. An electron gun assembly in accordance with claim 3 wherein said center beading support member is formed of type 42 alloy and said outer beading support members are formed of type 52 alloy.

5. An electron gun assembly in accordance with claim 3 wherein the ratio of the thermal expansion coefficients of the outer beading support members to the center beading support member is between about 1.8 to about 2.6.

6. In an electron gun assembly for a color television picture tube comprising a cathode assembly secured to a pair of oppositely-disposed insulating support rods, said cathode assembly including a center cathode disposed between two outer cathodes, each of said cathodes being supported by a separate cathode support assembly comprising a cathode eyelet and a beading support member, wherein each of said beading support members varies in dimensions as a function of temperature and the center beading support member stabilizes at a higher operating temperature than the outer beading support members, each of said beading support members having opposite ends which are embedded in said support rods, the improvement wherein said center beading support member being formed of a material having a thermal expansion coefficient between about 4.0 to about 4.7 microns per meter per degree centigrade and said outer beading support members being formed from a material having a thermal expansion coefficient between about 9.6 to about 10.1 microns per meter per degree centigrade whereby said outer beading support members expand more than said center beading support member by substantially equal to one another so that said cathode assembly is rigidly affixed to said support rods.

* * * * *